United States Patent [19]

Masaki et al.

[11] 4,132,198

[45] Jan. 2, 1979

[54] AIR-FUEL MIXTURE CONTROL SYSTEM

[75] Inventors: Kenji Masaki; Kenji Okamura, both of Yokohama, Japan

[73] Assignee: Nissan Motor Company, Limited, Yokohama, Japan

[21] Appl. No.: 722,268

[22] Filed: Sep. 10, 1976

[30] Foreign Application Priority Data

Sep. 11, 1975 [JP] Japan ..... 50/110163

[51] Int. Cl.[2] ..... F02M 7/00; F02B 33/00

[52] U.S. Cl. ..... 123/119 LR; 123/119 EC; 60/276; 60/285

[58] Field of Search ..... 60/276, 274, 282, 285, 60/299; 123/119 EC, 119 R, 32 EA, 119 LR

[56] References Cited

U.S. PATENT DOCUMENTS 3,142,967 8/1964 Schweitzer ..... 123/119 EC 3,861,366 1/1975 Masaki ..... 123/119 EC 3,921,612 11/1975 Aono ..... 123/119 EC

FOREIGN PATENT DOCUMENTS 2360621 7/1974 Fed. Rep. of Germany ..... 123/32 EA

*Primary Examiner*—Ronald B. Cox

*Attorney, Agent, or Firm*—Bacon & Thomas

[57] ABSTRACT

Rich and lean air-fuel mixtures are fed respectively to some combustion chamber or chambers and the remaining combustion chamber or chambers of an engine by fuel flow control means for increasing and reducing the flow of fuel drawn from a fuel passage of a carburetor into an intake passageway thereof, and second control means for causing the fuel flow control means to alternately or cyclically increase and reduce the flow of the fuel in synchronism with the speed of the engine.

16 Claims, 4 Drawing Figures

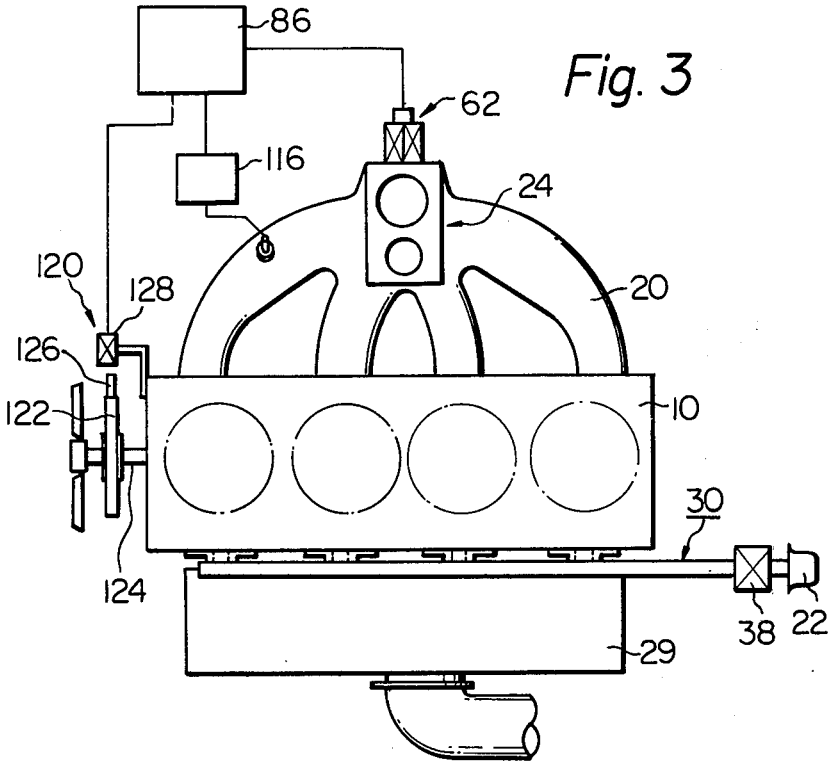
Fig. 3
Fig. 4
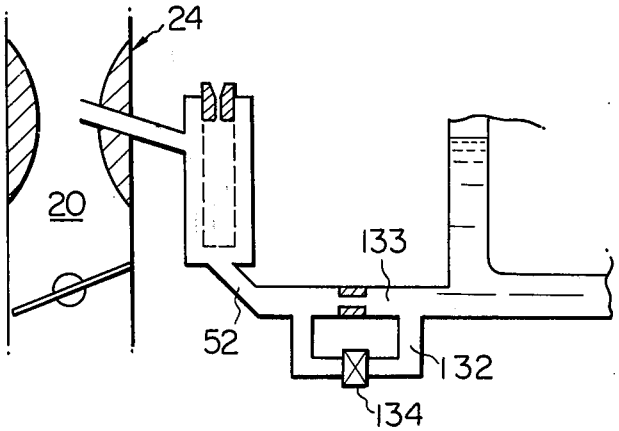

AIR-FUEL MIXTURE CONTROL SYSTEM

The present invention relates generally to a system for alternately or cyclically providing rich and lean air-fuel mixtures by employing a single air-fuel mixture forming device without providing two air-fuel mixture forming devices and particularly to an air-fuel mixture control system which has the air-fuel mixture forming device alternately or cyclically provide rich and lean air-fuel mixtures by providing a simple expedient comprising passage means for causing an increase and a decrease in the flow of fuel fed from the mixture forming device into the engine, and control means for controlling the cross sectional area of the passage means to increase and reduce the fuel flow into the engine in accordance with the speed of the engine.

As is well known in the art, an internal combustion engine is provided in its exhaust system with an exhaust gas reburning device such as a thermal reactor which oxidizes burnable components such as hydrocarbons (HC) and carbon monoxide (CO) present in exhaust gas from the engine into water ($H_2O$) and carbon dioxides ($CO_2$). It is necessary for making it possible for the exhaust gas reburning device to satisfactorily and/or efficiently burn the burnable components in the engine exhaust gas that the engine exhaust gas fed to the exhaust gas reburning device has a sufficiently high temperature and moderate quantities of hydrocarbons and carbon monoxide. In this instance, it is possible to reduce the quantities of hydrocarbons and carbon monoxide as the temperature of the engine exhaust gas increases and on the contrary it is necessary to increase the quantities of hydrocarbons and carbon monoxide as the temperature of the engine exhaust gas reduces.

Lean, rich and rich-lean mixture types are known as the types of the exhaust gas reburning device.

(1) The lean mixture type

This is an exhaust gas reburning device of a type which is fed with exhaust gas from an engine employing a lean air-fuel mixture having an air-fuel ratio such as, for example, within a range of 16 to 19 higher than a stoichiometric air-fuel ratio which is equal to about 14.8 when gasoline is used as fuel. In this instance, since exhaust gas resulting from the lean air-fuel mixture contains relatively small quantities of burnable components such as hydrocarbons and carbon monoxide, it is necessary for having the exhaust gas reburning device efficiently burn the burnable components in the exhaust gas that the temperature of the exhaust gas is relatively high. For this purpose, the ignition timing of the engine is usually set at a value later than an optimum ignition timing. This degrades the performance of the engine to cause a further decrease in the output which is reduced owing to the use of the lean air-fuel mixture and a pronounced increase in the fuel consumption. However, on the contrary, since exhaust gas resulting from the combustion of the lean air-fuel mixture contains a relatively large quantity of air, the exhaust gas reburning device can burn the burnable components in the exhaust gas without receiving secondary air. Accordingly, a relatively expensive secondary air supply device can be dispensed with.

(2) The rich mixture type

This is an exhaust gas reburning device of a type which is fed with exhaust gas of an engine employing a rich air-fuel mixture having an air-fuel ratio such as, for example, within a range of 11 to 14 which is lower than the stoichiometric air-fuel ratio. In this instance, since exhaust gas resulting from the combustion of the rich air-fuel mixture contains relatively large quantities of burnable components such as hydrocarbons and carbon monoxide, the exhaust gas reburning device can efficiently burn the burnable components in the exhaust gas even if the temperature of the exhaust gas is relatively low. Accordingly, it is unnecessary to take a measure such as retarding the engine ignition timing at the sacrifice of the output and fuel economy. However, since the exhaust gas of the rich air-fuel mixture is almost in the absence of air, it is necessary for having the exhaust gas reburning device burn the burnable components in the exhaust gas to provide the engine with a secondary air supply device having an expensive air pump and to supply a relatively large quantity of secondary air into the exhaust gas. On the other hand, the use of the rich air-fuel mixture causes an increase in the fuel consumption.

(3) The rich-lean mixture type

This is an exhaust gas reburning device of a type which is fed with exhaust gas of an engine having combustion chamber or chambers employing a lean air-fuel mixture and the remaining combustion chamber or chambers employing a rich air-fuel mixture. In this instance, it is necessary to provide the engine with two mixture forming devices for forming the rich and lean air-fuel mixtures. This causes the complication of the intake system of the engine. However, since exhaust gases resulting respectively from the combustion of the lean and rich air-fuel mixtures contain relatively large quantities of air and burnable components such as hydrocarbons and carbon monoxide, the exhaust gas reburning device can satisfactorily burn the burnable components in the exhaust gases by supplying secondary air into only the exhaust gas of the rich air-fuel mixture and even if the temperature of the exhaust gases is relatively low. Accordingly, it is possible to employ a secondary air supply device of a type, for example, which admits atmospheric air into engine exhaust gas through a check valve opened in response to a negative pressure of a pressure pulsation produced in the exhaust gas flow and accordingly the secondary air supply capacity of which is low but which is inexpensive, in lieu of a high capacity secondary air supply device including an expensive air pump.

Comparing collectively the exhaust gas reburning devices of the three types as mentioned above with each other, the exhaust gas reburning device of the rich-lean mixture type is extremely advantageous in the performance of reducing the contents of burnable components in engine exhaust gas, the engine output, the fuel consumption, and the production cost if the rich and lean air-fuel mixtures can be provided respectively for combustion chamber or chambers of an engine and the remaining combustion chamber or chambers thereof by simple means.

It is, therefore, an object of the invention to provide an air-fuel mixture control system which has an air-fuel mixture forming device alternately or cyclically provide rich and lean air-fuel mixtures by a simple expedient comprising passage means for increasing and reducing the flow of fuel fed from the air-fuel mixture forming device into the engine, valve means operable to close and open the passage means, operating means for operating the valve means, and control means for causing the operating means to operate the valve means to increase and reduce the fuel flow into the engine in accordance with the speed of the engine.

This and other objects and advantages of the invention will become more apparent from the following detailed description taken in connection with the accompanying drawings in which:

FIGS. 3 and 4 are schematic views of second and third preferred embodiments of an air-fuel mixture control system according to the invention, respectively.

Figure 1:
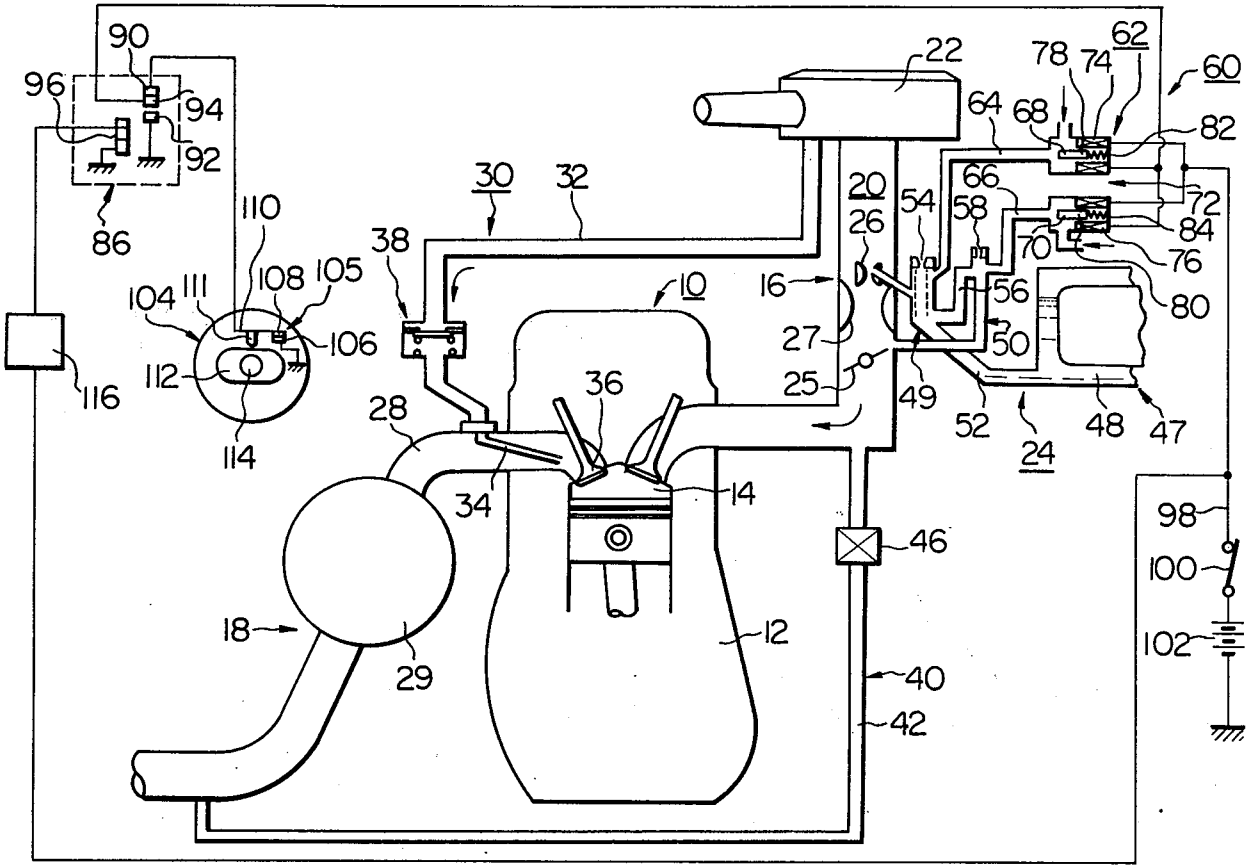
FIG. 1 is a schematic view of a first preferred embodiment of an air-fuel mixture control system according to the invention.

Referring to FIG. 1 of the drawings, there is shown an internal combustion engine 10 and an air-fuel mixture control system according to the invention which is combined with the engine 10. The engine 10 includes any engine proper 12 having a combustion chamber 14, and intake and exhaust systems 16 and 18. The intake system 16 includes an intake passageway 20 providing communication between an intake port (no numeral) of the combustion chamber 14 and the atmosphere, an air cleaner 22 opening into the atmosphere and communicating with the intake passageway 20, and a carburetor 24 having a part of the intake passageway 20, a throttle valve 25 rotatably located in the intake passageway 20, and small and large venturis 26 and 27 formed in the intake passageway 20 upstream of the throttle valve 25. The exhaust system 18 includes an exhaust gas passageway 28 providing communication between an exhaust port (no numeral) of the combustion chamber 14 and the atmosphere, and an exhaust gas purifying device 29 such as a thermal reactor or a catalytic converter which oxidizes burnable components such as hydrocarbons (HC) and carbon monoxide (CO) contained in exhaust gas of the engine 10 to purify the engine exhaust gas. The engine also includes a secondary air supply device 30 including a secondary air supply passage 32 extending from the air cleaner 22 to the exhaust gas passageway 28 upstream of the exhaust gas purifying device 29, an air nozzle 34 communicating with the passage 32 and extending directly behind an exhaust valve 36 of the engine 10, and a check valve 38 disposed in the passage 32. The check valve 38 is operable to open the passage 32 to cause atmospheric air to be drawn into the exhaust gas passageway 28 in response to a negative pressure of a pulsation of the exhaust gas pressure which pulsation is produced in the exhaust gas passageway 28. The engine 10 is also provided with an exhaust gas recirculation (EGR) device 40 serving to feed a part of the engine exhaust gas into the combustion chamber 14 for lowering the temperature of combustion therein to a suitable value to reduce the amount of nitrogen oxides (NOx) produced by high temperature combustion of an air-fuel mixture in the combustion chamber 14. The EGR device 40 includes an exhaust gas recirculation (EGR) passageway 42 providing communication between the exhaust gas passageway 28 downstream of the exhaust gas purifying device 29 and the intake passageway 20 downstream of the throttle valve 25, and an exhaust gas recirculation (EGR) control valve 46 disposed in the EGR passageway 42 for controlling the amount of engine exhaust gas fed into the intake passageway 20 to a predetermined value in accordance with, for example, the vacuum in the venturi 27 of the carburetor 24.

The carburetor 24 also includes a fuel bowl 47 containing liquid fuel 48 therein, a main system 49 and a low speed running system 50. The main system 49 has a main fuel passageway 52 communicating with the fuel bowl 47 and opening into the venturi 26, and a main air bleed 54 communicating with the atmosphere and with the main fuel passage 52 and through which air is drawn thereinto to atomize or emulsify fuel drawn therefrom into the intake passageway 20. The low speed system 50 has a low speed running fuel passage 56 branching off from the main fuel passage 52 and opening into the intake passageway 20 adjacent to the throttle valve 25, and a low speed air bleed 58 communicating with the atmosphere and with the low speed running fuel passage 56 and through which air is drawn thereinto to atomize or emulsify fuel drawn therefrom into the intake passageway 20.

The air-fuel mixture control system, generally designated by the reference numeral 60, comprises fuel flow control means 62 which is combined with the carburetor 24. The fuel flow control means 62 comprises in this embodiment first and second additional air bleed passages 64 and 66 communicating each with the atmosphere and respectively with the main and low speed running fuel passages 52 and 56 to feed into same additional air for atomizing or emulsifying fuel drawn from the same into the intake passageway 20, first and second control valves 68 and 70 located respectively with respect to the air bleed passages 64 and 66 and operable to close and open same, and operating means 72 for operating first and second control valves 68 and 70. When the control valves 68 and 70 open the air bleed passages 64 and 66, respectively, the additional air is drawn through the passages 64 and 66 into the main and low speed running fuel passages 52 and 56 to reduce the flow of fuel drawn therefrom into the intake passageway 20 by the share of the additional air to cause the carburetor 24 to provide a lean air-fuel mixture. On the contrary, when the air bleed passages 64 and 66 are closed respectively by the control valves 68 and 70, the additional air is inhibited to be drawn through the passages 64 and 66 into the main and low speed running fuel passages 52 and 56 to increase the flow of fuel drawn therefrom into the intake passageway 20 by the share of the additional air to cause the carburetor 24 to provide a rich air-fuel mixture.

Figure 2:
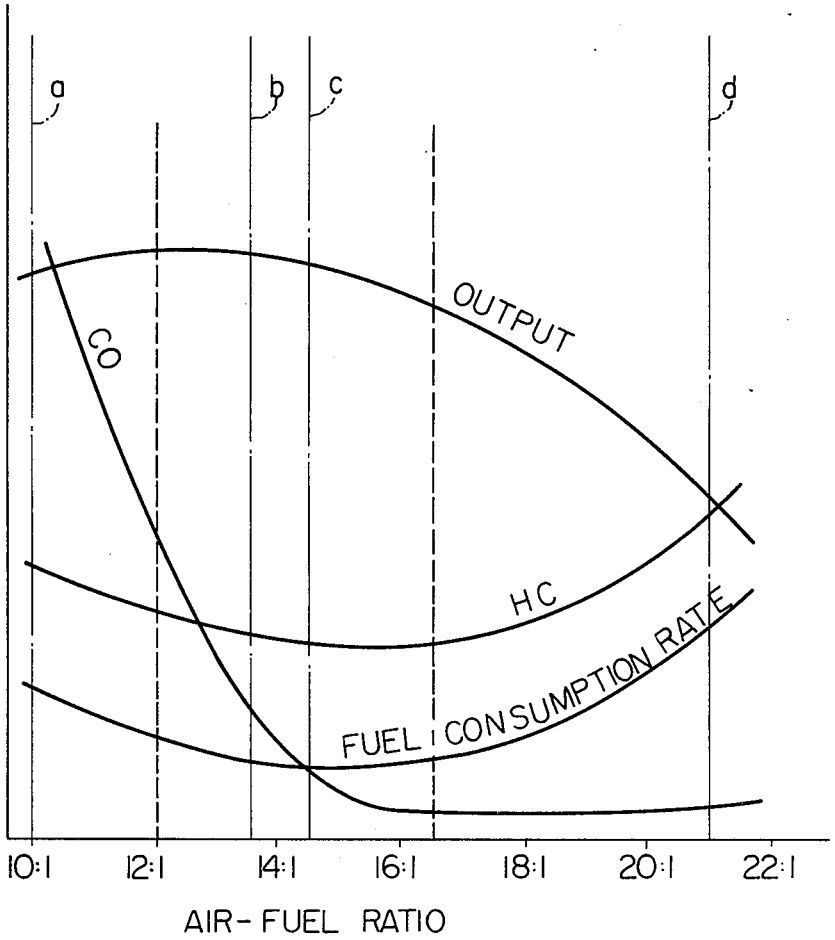
FIG. 2 is a graphic representation of the relationship among the air-fuel ratio of an air-fuel mixture for an engine, the contents of burnable components in exhaust gas resulting from the mixture, and the output and fuel consumption.

Referring to FIG. 2 of the drawings, there is shown the relationship among the air-fuel ratio of an air-fuel mixture burned in an engine and employing gasoline as fuel, the output and fuel consumption resulting from the combustion of the air-fuel mixture, and the content of each of hydrocarbons (HC) and carbon monoxide (CO) contained in exhaust gas resulting from the combustion of the air-fuel mixture. In FIG. 2, the range between the lines a and b is a first range (about 10 to 13.5) of the air-fuel ratio of rich air-fuel mixtures producing exhaust gases having an adequate or necessary quantity of burnable components such as hydrocarbons and carbon monoxide for burning of the burnable components in an exhaust gas reburning device, while the range between the lines c and d is a second range (about 14.8 to 21) of the air-fuel ratios of lean air-fuel mixtures which do not cause an excessive decrease in the output and an excessive increase in the fuel consumption. These air-fuel ratios are obtained by selecting, for example, the cross sectional areas of the main and low speed running fuel passages 52 and 56 and the first and second air bleed passages 64 and 66. It is desirable to set the air-fuel ratios of the rich and lean air-fuel mixtures provided by the carburetor 24 and the air-fuel mixture control system 60 at values within the first and second ranges, respectively.

Returning to FIG. 1, the operating means 72 comprises first and second solenoids 74 and 76, first and second cores 78 and 80 forming the cores of the solenoids 74 and 76 and fixedly connected respectively to the control valves 68 and 70, and first and second springs 82 and 84 urging the cores 78 and 80 in first positions in which the control valves 68 and 70 closes the air bleed passages 64 and 66, respectively. The solenoids 74 and 76, when deenergized, allow the springs 82 and 84 to force the cores 78 and 80 into the first positions and, when energized, move the cores 78 and 80 with their magnetic forces in opposition to the force of the springs 82 and 84 into second positions in which the control valves 68 and 70 open the air bleed passages 64 and 66, respectively.

First switching-over means 86 is provided to control the solenoids 74 and 76 to switch over the mixture formed by the carburetor 24 between the lean air-fuel mixture and the rich air-fuel mixture in accordance with an operating condition of the engine 10. The control means 86 comprises a relay including first and second stationary contacts 90 and 92, a movable contact 94 electrically connected to the negative terminals of the solenoids 74 and 76 and interposed between the stationary contacts 90 and 92 to alternatively engage same, and a relay coil 96 electrically connected to the positive terminals of the solenoids 74 and 76 and grounded. The second stationary contact 92 is grounded. The movable contact 94 is normally engaged with the first stationary contact 90. The relay coil 96, when deenergized, causes the movable contact 94 to engage the first stationary contact 90 and, when energized, moves the movable contact 94 into a position in which the movable contact 94 engages the second stationary contact 92. The positive terminals of the solenoids 74 and 76 are electrically connected to an electric circuit 98 having an ignition switch 100 and an electric power source 102 such as a storage battery grounded which are electrically connected in series to each other.

Second switching-over means 104 is provided to alternately energize and deenergize the solenoids 74 and 76 in synchronism with the speed of the engine 10 and is electrically connected to the first stationary contact 90. The second switching-over means 104 comprises a switch 105 having stationary and movable contacts 106 and 108, and a switch arm 110 having an engaging member 111 at its mid portion and a free end supporting the movable contact 108. The switch air 110 is swingable between a first position in which the movable contact 108 is engaged with the stationary contact 106 to close the switch 105 and a second position in which the movable contact 108 is disengaged from the stationary contact 106 to open the switch 105. A cam 112 is provided to rotate in synchronism with the speed of the engine 10 to engage the engaging member 111 of the switch arm 110 for swinging same to move it between the first and second positions. In this instance, the cam 112 is shaped and rotated in such a manner that the swtich 105 is alternately closed and opened a time or times equal to the number of the combustion chamber or chambers 14 per 2 revolutions of a crankshaft (not shown) of the engine 10 when the engine 10 is of 4 cycle type or per 1 revolution of the crankshaft when the engine 10 is of 2 cycle type to alternately feed a rich air-fuel mixture and a lean air-fuel mixture to the engine 10 every combustion or ignition of the combustion chamber or chambers 14. The cam 112 is in the form of, for example, an ellipse rotatably supported at the center 114 in this embodiment and engages the projection 111 of the switch arm 110 to intermittently open and close the switch 105 two times per revolution of the cam 112. Accordingly the cam 112 is rotated at half the speed of the crankshaft of the engine 10 when the engine 10 is, for example, of 4 cycle and 4 combustion chamber type or at the same speed as that of the crankshaft when the engine 10 is of 4 cycle and 8 combustion chamber type. In this instance, it will be understood that a group of combustion chambers of the engine 10 are fed with only one of the rich and lean air-fuel mixtures and the remaining group of combustion chambers are fed with only the other air-fuel mixture.

Sensing means 116 is provided to sense an operating condition of the engine 10 or a motor vehicle equipped with the engine 10 in which condition the temperature of exhaust gas of the engine 10 is increased above a predetermined value as when the vehicle is travelling at a high speed, for example, above 60 km/hr or at a high load. The sensing means 116 is electricly connected to the relay coil 96 and comprises, for example, a vehicle speed sensing device and/or a vehicle load sensing device such as a vehicle speed sensor, a sensor for sensing the vacuum in the intake passageway 20 downstream of the throttle valve 25, a sensor for sensing the degree of opening of the throttle valve 25, and/or an engine speed sensor. The sensing means 116 produces an electric command signal which is fed to the relay coil 96 to energize it to switch over the engagement of the movable contact 94 from the first stationary contact 90 to the second stationary contact 92 when the sensing means 116 senses the engine operating condition as mentioned above.

The air-fuel mixture control system 60 thus far described is operated as follows:

When the engine 10 is running with the movable contact 94 of the switching-over means 86 engaged with the first stationary contact 90, the cam 112 is rotated to swing the switch arm 110 to alternately close and open the switch 105 every combustion or ignition of the combustion chamber or chambers 14 of the engine 10. As a result, the energization and deenergization of each of the solenoids 74 and 76 are alternately provided to cause the control valves 68 and 70 to alternately open and close the air bleed passages 64 and 66, respectively. Accordingly, the carburetor 24 alternately provides a rich air-fuel mixture and a lean air-fuel mixture every combustion or ignition of the engine 10 which are drawn into the combustion chamber or chamber 14 in accordance with the ignition sequence of the engine 10. The rich and lean air-fuel mixtures, after burned in the engine 10, produce two kinds of exhaust gases one of which contains proper amounts of burnable components such as hydrocarbons (HC) and carbon monoxide (CO) and the other of which contains a proper amount of air and which are alternately fed into the exhaust gas purifying device 29.

Since the exhaust gas resulting from the lean air-fuel mixture contains air necessary for burning the burnable components in the exhaust gas purifying device 29, the secondary air supply device 30 is constructed and arranged so as to feed secondary air into the exhaust gases resulting from the rich air-fuel mixture.

When the sensing means 116 senses an operating condition of the engine 10 or vehicle such as the vehicle speed or engine load in which condition the temperature of the engine exhaust gas is increased above a predetermined value to produce a command signal, the relay coil 96 is energized by the command signal to switch over the connection of the movable contact 94 from the first stationary contact 90 to the second stationary contact 92. Accordingly, the solenoids 74 and 76 are disconnected from the second switching-over means 104 and are connected to the stationary contact 92 so that they are continuously held in their energized conditions. As a result, the air bleed passages 64 and 66 are continuously opened respectively by the control valves 68 and 70 to cause the carburetor 24 to provide a lean air-fuel mixture. Thus, all the combustion chambers 14 of the engine 10 is fed with the lean air-fuel mixture only to make the exhaust gas purifying device 29 into the lean mixture type. In this instance, the purifying device 29 satisfactorily and/or efficiently burns the burnable components in the engine exhaust gases. Concurrently the fuel consumption is reduced and the purifying device 29 is prevented from being damaged by heat.

Although the cam 112 is shaped to make the air-fuel mixture fed to the combustion chamber or chambers 14 of the engine 10 successively rich-lean-rich-lean, the shape of the cam 112 may be varied or selected to make the sequence of the richness and leanness of the air-fuel mixture successively burned in the engine 10 into various modes such as, for example, rich-rich-lean-lean or as becoming rich for only one of the combustion chambers.

The control valve 70, solenoid 76, core 80 and spring 84 for the second air bleed passage 66 may be omitted to have the low speed running system of the carburetor 24 provide the rich air-fuel mixture only. This is because the temperature of the engine exhaust gas is low and accordingly it is necessary for having the exhaust gas purifying device 29 satisfactorily burn the burnable components in the engine exhaust gas to feed the rich air-fuel mixture into the engine 10, when the low speed running system is operative to provide the air-fuel mixture as during engine idling operation.

Referring to FIG. 3 of the drawings, there is shown a second preferred embodiment of an air-fuel mixture control system according to the invention. The air-fuel mixture control device 118 is characterized in that second switching-over means 120 is provided in lieu of the second switching-over means 104 shown in FIG. 1. In FIG. 3, like component elements and parts are designated by the same reference numerals as those used in FIG. 1. The second switching-over means 120 comprises a disk 122 fixedly mounted on a crankshaft 124 of the engine 10, a projection 126 made of a permanent magnet located on the circumference of the disk 122, and a pick-up coil 128 located to face the projection 126 and elecrically connected to the first stationary contact 90. An electromotive force or voltage is induced into the induction coil 128 when the projection 126 passes to face the induction coil 128 every revolution of the crankshaft 124. When the voltage is induced in the induction coil 128 with the movable contact 94 connected with the first stationary contact 90, the solenoids 74 and 76 are energized. When no voltage is induced in the induction coil 128, the solenoids 74 and 76 are deenergized.

Referring to FIG. 4 of the drawings, there is shown a third preferred embodiment of an air-fuel mixture control system according to the invention. In FIG. 4, like component elements and parts are designated by the same reference numerals as those used in FIG. 1. The air-fuel mixture control system 130 shown in FIG. 4 is characterized in that the fuel flow control means 62 comprises passage means 132 bypassing a part 133 of the main fuel passage 52 upstream of the junction of the main and low speed running fuel passages 52 and 56, and a control valve 134 disposed in the passage means 132 and operable to open and close it. The control valve 134 includes operating means (no numeral) for operating the control valve 134. The operating means may be a solenoid and is electrically connected to the first stationary contact 90. The operating means causes the control valve 134 to close the passage means 132 to reduce the flow of fuel drawn from the main and low speed running fuel passages 52 and 56 into the intake passageway 20 to have the carburetor 24 provide the lean air-fuel mixture when the movable contact 94 is connected to the stationary contact 92 or the switch 105 is closed. On the contrary, when the switch 105 is opened, the operating means causes the control valve 134 to open the passage means 132 to have the carburetor 24 provide the rich air-fuel mixture.

It will be appreciated that the invention provides an air-fuel mixture control system which has a carburetor alternately or cyclically provide rich and lean air-fuel mixtures by simple fuel flow control means which directly or indirectly increase and reduce the flow of fuel drawn from a fuel passage of the carburetor into an intake passageway thereof in synchronism with the speed of the engine in such a manner as to feed the rich air-fuel mixture to some combustion chamber or chambers of the engine and the lean air-fuel mixture to the remaining combustion chamber or chambers so that two kinds of differently composed exhaust gases are produced which contain relatively large quantities of burnable components such as hydrocarbons (HC) and carbon monoxide (CO) and a relatively large quantity of air, respectively to make it possible for an exhaust gas purifying device to satisfactorily burn burnable components in the exhaust gases with merely a secondary air supply device employed which is in a small capacity and is inexpensive and also even when the temperature of the exhaust gases is low without taking a measure for increasing the temperature of the exhaust gases such as retarding the engine ignition timing to increase the output performance of the engine and to prevent the temperature of the exhaust gas purifying device from being excessively increased and the purifying device from being excessively heated.

It will be also appreciated that the air-fuel mixture control system comprises means for having the carburetor provide the lean air-fuel mixture only when the temperature of the exhaust gases is increased to a high value as during engine operations at a high speed and at a high load so that the fuel consumption of the engine is reduced and the exhaust gas purifying device is prevented from being damaged by heat.

What is claimed is:

1. An air-fuel mixture control system in combination with an internal combustion engine including a plurality of combustion chambers, a carburetor having a main fuel passage, and an intake passageway for conducting air into the combustion chambers, said air-fuel mixture control system comprising fuel flow control means comprising an air bleed passage communicating with the atmosphere and with the main fuel passage, a control valve operable for closing and opening said air bleed passage for controlling the flow of air into the main fuel passage through said air bleed passage for, in turn, controlling the flow of fuel drawn from the main fuel passage into the intake passageway to form rich and lean air-fuel mixtures, respectively, and operating means for operating said control valve into first and second positions to close and open said air bleed passage, respectively; means for generating a predetermined pattern of first and second fuel flow signals in synchronization with the intake operation of the combustion chambers of the engine and for sending said signals to said operating means to provide different air-fuel mixtures to different combustion chambers; said first signal actuating said operating means to place said valve in said first position to, in turn, provide the rich air-fuel mixture, said second signal actuating said operating means to place said valve in said second position to, in turn, provide the lean air-fuel mixture.

2. An air-fuel mixture control system as claimed in claim 1, in which the carburetor further includes a low speed running fuel passage and said fuel flow control means further comprises a second air bleed passage communicating with the atmosphere and with the low speed running fuel passage, a second control valve operable for closing and opening said second air bleed passage for controlling the flow of air into the low speed running fuel passage through said second air bleed passage for, in turn, controlling the flow of fuel drawn from the low speed running fuel passage into the intake passageway to form rich and lean air-fuel mixtures, respectively, and second operating means for operating said second control valve into first and second positions to close and open said second air bleed passage, said signal generating means being electrically connected to said second operating means for feeding said first and second signals thereto for causing said second operating means to operate said second control valve into said first and second positions respectively in accordance with the predetermined pattern and in synchronism with the intake operations of the combustion chambers.

3. An air-fuel mixture control system as claimed in claim 1, in which said signal generating and sending means comprises a movable contact electrically connected to said operating means, a stationary contact electrically connected to ground, and a cam having a shape representative of said predetermined pattern, said cam being rotated in synchronism with the intake operations for engaging and disengaging said movable contact with and from said stationary contact for causing said first and second fuel flow signals to be generated in accordance with said predetermined pattern.

4. An air-fuel mixture control system as claimed in claim 3, in which said cam comprises a plate in the shape of an ellipse and rotatable in synchronism with the speed of said engine to disengage said movable contact from said stationary contact at its longitudinal ends two times per revolution of said plate.

5. An air-fuel mixture control system as claimed in claim 1, in which said signal generating and sending means comprises a disk rotated in synchronism with the intake operations of the engine, and a permanent magnet fixedly mounted on the circumference of said disk to represent said predetermined pattern, whereby the sequence of movement of said permanent magnet contributes to generation of the first and second fuel flow signals, said signal generating and sending means also comprising a coil located to confront said permanent magnet and electrically connected to said operating means for generating said first and second signals in accordance with the movement of said permanent magnet when said disk is rotated.

6. An air-fuel mixture control system as claimed in claim 1 in which the engine further includes an exhaust system having an exhaust gas passageway extending from the engine to the atmosphere, and exhaust gas purifying device located in the exhaust gas passageway and oxidizing burnable components contained in exhaust gas of the engine to purify the engine exhaust gas, a secondary air supply device having passage means communicating with the atmosphere and extending immediately downstream of an exhaust port of the engine, and a check valve located in the passage means and opened in response to a negative pressure produced in the exhaust gas passageway to allow atmospheric air to be drawn thereinto.

7. An air-fuel mixture system as claimed in claim 1, in which the engine further includes an exhaust gas recirculation device having an exhaust gas recirculation (EGR) passageway providing communication between the exhaust gas passageway and the intake passageway to feed the engine exhaust gas thereinto, and an exhaust gas recirculation control valve disposed in the EGR passageway to meter the amount of the engine exhaust gas fed into the intake passageway to a predetermined ratio to that of air taken in the engine.

8. An air-fuel mixture control system in combination with an internal combustion engine including a plurality of combustion chambers, a carburetor having a main fuel passage, and an intake passageway for conducting air into the combustion chambers, said air-fuel mixture control system comprising: fuel flow control means including an air bleed passage communicating with the atmosphere and with the main fuel passage, a control valve operable for closing and opening said air bleed passage for controlling the flow of air into the main fuel passage through said air bleed passage for, in turn, controlling the flow of fuel drawn from the main fuel passage into the intake passageway to form rich and lean air-fuel mixtures, respectively, and operating means for operating said control valve into first and second positions to close and open said air bleed passage, respectively; means for generating a predetermined pattern of first and second fuel flow signals in synchronization with the intake operations of the combustion chambers of the engine to provide different air-fuel mixtures to different combustion chambers; said first signal actuating said operating means to place said valve in said first position to, in turn, provide the rich air-fuel mixture, said second signal actuating said operating means to place said valve in said second position to, in turn, provide the lean air-fuel mixture; means for continuously causing said operating means to operate said control valve into said second position for having the carburetor form only a lean air-fuel mixture when disconnected from said operating means; means for providing connection between said signal generating means and said operating means in response to a first operating condition of the engine in which the temperature of exhaust gases of the engine is below a predetermined value and for rendering said connection ineffective in response to a second operating condition of the engine in which the temperature of exhaust gases of the engine is above said predetermined value, and sensing means connected to said providing means for sensing said first and second operating conditions of the engine.

9. An air-fuel mixture control system as claimed in claim 8, in which said connection providing means comprises a first stationary contact electrically connected to said signal generating means, a second stationary contact which is grounded, a movable contact electrically connected to said operating means and to an electric power source and normally connected to said first stationary contact, and a relay coil electrically connected to an electric power source and to said sensing means to receive said command signal to switch over the connection of said movable contact from said first stationary contact to said second stationary contact.

10. An air-fuel mixture control system in combination with an internal combustion engine including a plurality of combustion chambers, a carburetor and an intake passageway for conducting air into the combustion chambers, said air-fuel mixture control system comprising: fuel flow control means for increasing and reducing the flow of fuel drawn from a fuel passage of the carburetor into air conducted by the intake passageway to form rich and lean air-fuel mixtures, respectively; means for generating a predetermined pattern of first and second fuel flow signals in synchronization with the intake operations of the combustion chambers of the engine and for sending said signals to said fuel flow control means to provide different air-fuel mixtures to different combustion chambers; said first signal actuating said fuel flow control means to provide the rich air-fuel mixture, said second signal actuating said fuel flow control means to provide the lean air-fuel mixture.

11. An air-fuel mixture control system in combination with an internal combustion engine including a plurality of combustion chambers, a carburetor and an intake passageway for conducting air into the combustion chambers, said air-fuel mixture control system comprising: fuel flow control means for increasing and reducing the flow of fuel drawn from a fuel passage of the carburetor into air conducted by the intake passageway to form rich and lean air-fuel mixtures, respectively; means selectively connectable with said fuel flow control means for generating a predetermined pattern of first and second fuel flow signals in synchronization with the intake operations of the combustion chambers of the engine to provide different air-fuel mixtures to different combustion chambers; said first signal actuating said fuel flow control means to provide the rich air-fuel mixture and said second signal actuating said fuel flow control means to provide the lean air-fuel mixture when the signal generating means is connected to the fuel flow control means; means for continuously causing said fuel flow control means to reduce the flow of fuel to form only a lean air-fuel mixture when said signal generating means is disconnected from said fuel flow control means; means for providing connection between said signal generating means and said fuel flow control means in response to a first operating condition of the engine in which the temperature of exhaust gases of the engine is below a predetermined value and for rendering said connection ineffective in response to a second operating condition of the engine in which the temperature of exhaust gases of the engine is above said predetermined value, and sensing means connected to said providing means for sensing said first and second operating conditions of the engine.

12. An air-fuel mixture control system in combination with an internal combustion engine including a plurality of combustion chambers, a carburetor having a main fuel passage, and an intake passageway for conducting air into the combustion chambers, said air-fuel mixture control system comprising: fuel flow control means having a bypass passage bypassing a part of the main fuel passage, a control valve operable for opening and closing said bypass passage for increasing and reducing the flow of fuel drawn from the main fuel passage into the intake passageway to, in turn, provide rich and lean air-fuel mixtures, respectively, and operating means for operating said control valve into first and second positions to open and close said bypass passage, respectively; means for generating a predetermined pattern of first and second fuel flow signals in synchronization with the intake operations of the combustion chambers of the engine and for sending said signals to said fuel flow control means to provide different air-fuel mixtures to different combustion chambers; said first signal actuating said operating means to place said valve in said first position to, in turn, provide the rich air-fuel mixture, said second signal actuating said operating means to place said valve in said second position to, in turn, provide the lean air-fuel mixture.

13. An air-fuel mixture control system in combination with an internal combustion engine including a plurality of combustion chambers, a carburetor and an intake passageway for conducting air into the conbustion chambers, said air-fuel mixture control system comprising: means for controlling the operation of said carburetor to provide different air-fuel ratios to different combustion chambers, said carburetor control means including means for changing the condition of the carburetor between a first condition to provide a rich fuel to air ratio in the mixture supplied by the carburetor and a second condition to provide a lean fuel to air ratio; and means for actuating said condition changing means to effect a shift between said first and second conditions in synchronization with the intake operations of the combustion chambers.

14. An air-fuel mixture control system in combination with an internal combustion engine including a plurality of combustion chambers, a carburetor and an intake passageway for conducting air into the combustion chambers, said air-fuel mixture control system comprising fuel flow control means for increasing and reducing the flow of fuel drawn from a fuel passage of the carburetor into air conducted by the intake passageway for thereby having the carburetor form rich and lean air-fuel mixtures, respectively, signal generating means connected to said fuel flow control means and actuable for alternatively generating, in accordance with a sequence determined by the intake operations of the combustion chambers of the engine, first and second signals for causing said fuel flow control means to increase and reduce the flow of said fuel, respectively, a fuel flow pattern representative of the pattern of the sequence of generation of said first and second signals, and actuating means having said fuel flow pattern and causing said second control means to generate said first and second signals in accordance with said fuel flow pattern and in synchronism with said respective intake operations.

15. An air-fuel mixture control system in combination with an internal combustion engine including a plurality of combustion chambers, a carburetor and an intake passageway for conducting air into the combustion chambers, said air-fuel mixture control system comprising fuel flow control means for increasing and reducing the flow of fuel drawn from a fuel passage of the carburetor into air conducted by the intake passageway for thereby having the carburetor form rich and lean air-fuel mixtures, respectively, signal generating means connected to and disconnected from said fuel flow control means and actuating for alternatively generating, in accordance with a sequence determined by the intake operation of each of the combustion chambers of the engine, first and second signals fed to said fuel flow control means for causing same to increase and reduce the flow of said fuel, respectively when connected to said fuel flow control means, said signal generating means continuously causing said fuel flow control means to reduce the flow of said fuel for having the carburetor form only a lean air-fuel mixture when disconnected from said fuel flow control means, a fuel flow pattern representative of the pattern of the sequence of generation of said first and second signals, actuating means having said fuel flow pattern and causing said signal generating means to generate said first and second signals in accordance with said fuel flow pattern and in synchronism with said respective intake operations when said signal generating means is connected to said fuel flow control means, switching over means for providing connection between said signal generating means and said fuel flow control means in response to a first operating condition of the engine in which the temperature of exhaust gases of the engine is below a predetermined value and for intercepting said connection in response to a second operating condition of the engine in which the temperature of exhaust gases of the engine is above said predetermined value, and sensing means connected to said switching-over means for sensing said first and second operating conditions of the engine.

* * * * *